US009297262B2

(12) United States Patent
Zhang et al.

(10) Patent No.: US 9,297,262 B2
(45) Date of Patent: Mar. 29, 2016

(54) COOLING STRUCTURES IN THE TIPS OF TURBINE ROTOR BLADES

(75) Inventors: Xiuzhang James Zhang, Simpsonville, SC (US); Aaron Ezekiel Smith, Simpsonville, SC (US); Anthony Louis Giglio, Simpsonville, SC (US); Brian Peter Arness, Greenville, SC (US); Benjamin Paul Lacy, Greer, SC (US)

(73) Assignee: General Electric Company, Schenectady, NY (US)

( * ) Notice: Subject to any disclaimer, the term of this patent is extended or adjusted under 35 U.S.C. 154(b) by 1086 days.

(21) Appl. No.: 13/479,683

(22) Filed: May 24, 2012

(65) Prior Publication Data

US 2013/0315749 A1 Nov. 28, 2013

(51) Int. Cl.
*F01D 5/18* (2006.01)
*F01D 5/20* (2006.01)

(52) U.S. Cl.
CPC . *F01D 5/20* (2013.01); *F01D 5/186* (2013.01)

(58) Field of Classification Search
CPC ..... F01D 5/186; F01D 25/12; F01D 5/20; F05D 2260/202; F05D 2260/24
USPC ..... 415/115; 416/92, 97 R
See application file for complete search history.

(56) References Cited

U.S. PATENT DOCUMENTS

| | | | | |
|---|---|---|---|---|
| 4,487,550 | A | 12/1984 | Horvath et al. | |
| 5,660,523 | A | 8/1997 | Lee | |
| 6,461,107 | B1 | 10/2002 | Lee et al. | |
| 6,461,108 | B1 | 10/2002 | Lee et al. | |
| 7,922,451 | B1 | 4/2011 | Liang | |
| 7,997,865 | B1 * | 8/2011 | Liang | 416/92 |
| 8,182,221 | B1 | 5/2012 | Liang | |
| 8,366,394 | B1 | 2/2013 | Liang | |
| 2002/0197159 | A1 * | 12/2002 | Roeloffs | 416/92 |
| 2004/0096690 | A1 * | 5/2004 | Kelly et al. | 428/632 |
| 2005/0232771 | A1 | 10/2005 | Harvey et al. | |
| 2005/0244270 | A1 | 11/2005 | Liang | |
| 2008/0298975 | A1 | 12/2008 | James et al. | |
| 2010/0111704 | A1 | 5/2010 | Hada | |
| 2010/0183427 | A1 | 7/2010 | Liang | |
| 2012/0201695 | A1 | 8/2012 | Little | |
| 2012/0282108 | A1 | 11/2012 | Lee et al. | |

FOREIGN PATENT DOCUMENTS

| | | | |
|---|---|---|---|
| DE | 19944923 | A1 | 3/2001 |
| EP | 2161412 | A2 | 3/2010 |
| EP | 2434097 | A1 | 3/2012 |
| EP | 2586981 | A2 | 5/2013 |
| EP | 2604796 | A2 | 6/2013 |

OTHER PUBLICATIONS

Search Report from EP Application No. 13168655.2 dated Aug. 9, 2013.

* cited by examiner

*Primary Examiner* — Edward Look
*Assistant Examiner* — Danielle M Christensen
(74) *Attorney, Agent, or Firm* — Mark E. Henderson

(57) ABSTRACT

A turbine rotor blade for a gas turbine engine is described. The turbine rotor blade includes an airfoil that includes a tip at an outer radial end. The tip includes a rail that defines a tip cavity; and the rail includes a circumscribing rail microchannel. The circumscribing rail microchannel is a microchannel that extends around at least a majority of the length of the inner rail surface.

19 Claims, 11 Drawing Sheets

COOLING STRUCTURES IN THE TIPS OF TURBINE ROTOR BLADES

BACKGROUND OF THE INVENTION

This application is related to Ser. No. 13/479,710 and Ser. No. 13/479,663, filed concurrently herewith, which are fully incorporated by reference herein and made a part hereof.

The present application relates generally to apparatus, methods and/or systems for cooling the tips of gas turbine rotor blades. More specifically, but not by way of limitation, the present application relates to apparatus, methods and/or systems related to microchannel design and implementation in turbine blade tips.

In a gas turbine engine, it is well known that air is pressurized in a compressor and used to combust a fuel in a combustor to generate a flow of hot combustion gases, whereupon such gases flow downstream through one or more turbines so that energy can be extracted therefrom. In accordance with such a turbine, generally, rows of circumferentially spaced rotor blades extend radially outwardly from a supporting rotor disk. Each blade typically includes a dovetail that permits assembly and disassembly of the blade in a corresponding dovetail slot in the rotor disk, as well as an airfoil that extends radially outwardly from the dovetail.

The airfoil has a generally concave pressure side and generally convex suction side extending axially between corresponding leading and trailing edges and radially between a root and a tip. It will be understood that the blade tip is spaced closely to a radially outer turbine shroud for minimizing leakage therebetween of the combustion gases flowing downstream between the turbine blades. Maximum efficiency of the engine is obtained by minimizing the tip clearance or gap such that leakage is prevented, but this strategy is limited somewhat by the different thermal and mechanical expansion and contraction rates between the rotor blades and the turbine shroud and the motivation to avoid an undesirable scenario of having excessive tip rub against the shroud during operation.

In addition, because turbine blades are bathed in hot combustion gases, effective cooling is required for ensuring a useful part life. Typically, the blade airfoils are hollow and disposed in flow communication with the compressor so that a portion of pressurized air bled therefrom is received for use in cooling the airfoils. Airfoil cooling is quite sophisticated and may be employed using various forms of internal cooling channels and features, as well as cooling holes through the outer walls of the airfoil for discharging the cooling air. Nevertheless, airfoil tips are particularly difficult to cool since they are located directly adjacent to the turbine shroud and are heated by the hot combustion gases that flow through the tip gap. Accordingly, a portion of the air channeled inside the airfoil of the blade is typically discharged through the tip for the cooling thereof.

It will be appreciated that conventional blade tip design includes several different geometries and configurations that are meant to prevent leakage and increase cooling effectiveness. Exemplary patents include: U.S. Pat. No. 5,261,789 to Butts et al.; U.S. Pat. No. 6,179,556 to Bunker; U.S. Pat. No. 6,190,129 to Mayer et al.; and, U.S. Pat. No. 6,059,530 to Lee. Conventional blade tip designs, however, all have certain shortcomings, including a general failure to adequately reduce leakage and/or allow for efficient tip cooling that minimizes the use of efficiency-robbing compressor bypass air. In addition, as discussed in more detail below, conventional blade tip design, particularly those having a "squealer tip" design, have failed to take advantage of or effectively integrate the benefits of microchannel cooling. As a result, an improved turbine blade tip design that increases the overall effectiveness of the coolant directed to this region would be in great demand.

BRIEF DESCRIPTION OF THE INVENTION

According to one aspect of the invention, the present application describes a turbine rotor blade for a gas turbine engine that includes an airfoil that and a tip at an outer radial end of the airfoil. The tip may include a rail that defines a tip cavity. The rail may include a circumscribing rail microchannel, which may include a microchannel that extends around at least a majority of the length of the inner rail surface.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
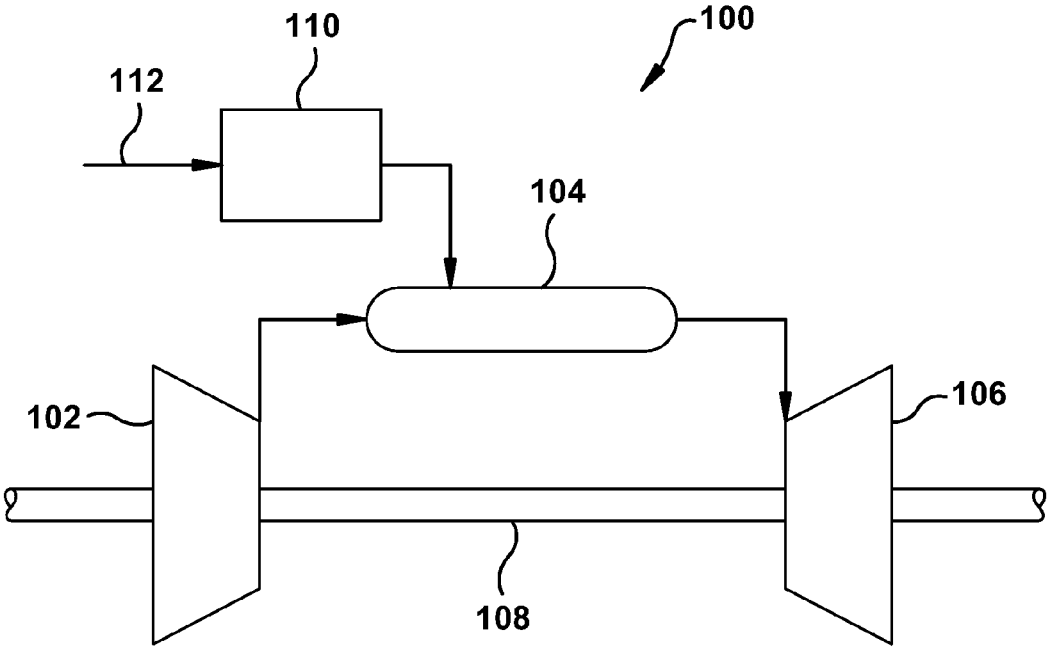
Figure 1 (Prior Art)
FIG. 1 is a schematic diagram of an embodiment of a turbomachine system.

FIG. 1 is a schematic diagram of an embodiment of a turbomachine system, such as a gas turbine system 100. The system 100 includes a compressor 102, a combustor 104, a turbine 106, a shaft 108 and a fuel nozzle 110. In an embodiment, the system 100 may include a plurality of compressors 102, combustors 104, turbines 106, shafts 108 and fuel nozzles 110. The compressor 102 and turbine 106 are coupled by the shaft 108. The shaft 108 may be a single shaft or a plurality of shaft segments coupled together to form shaft 108.

In an aspect, the combustor 104 uses liquid and/or gas fuel, such as natural gas or a hydrogen rich synthetic gas, to run the engine. For example, fuel nozzles 110 are in fluid communication with an air supply and a fuel supply 112. The fuel nozzles 110 create an air-fuel mixture, and discharge the air-fuel mixture into the combustor 104, thereby causing a combustion that creates a hot pressurized exhaust gas. The combustor 100 directs the hot pressurized gas through a transition piece into a turbine nozzle (or "stage one nozzle"), and other stages of buckets and nozzles causing turbine 106 rotation. The rotation of turbine 106 causes the shaft 108 to rotate, thereby compressing the air as it flows into the compressor 102. In an embodiment, hot gas path components, including, but not limited to, shrouds, diaphragms, nozzles, buckets and transition pieces are located in the turbine 106, where hot gas flow across the components causes creep, oxidation, wear and thermal fatigue of turbine parts. Controlling the temperature of the hot gas path components can reduce distress modes in the components. The efficiency of the gas turbine increases with an increase in firing temperature in the turbine system 100. As the firing temperature increases, the hot gas path components need to be properly cooled to meet service life. Components with improved arrangements for cooling of regions proximate to the hot gas path and methods for making such components are discussed in detail below with reference to FIGS. 2 through 12. Although the following discussion primarily focuses on gas turbines, the concepts discussed are not limited to gas turbines.

Figure 2:
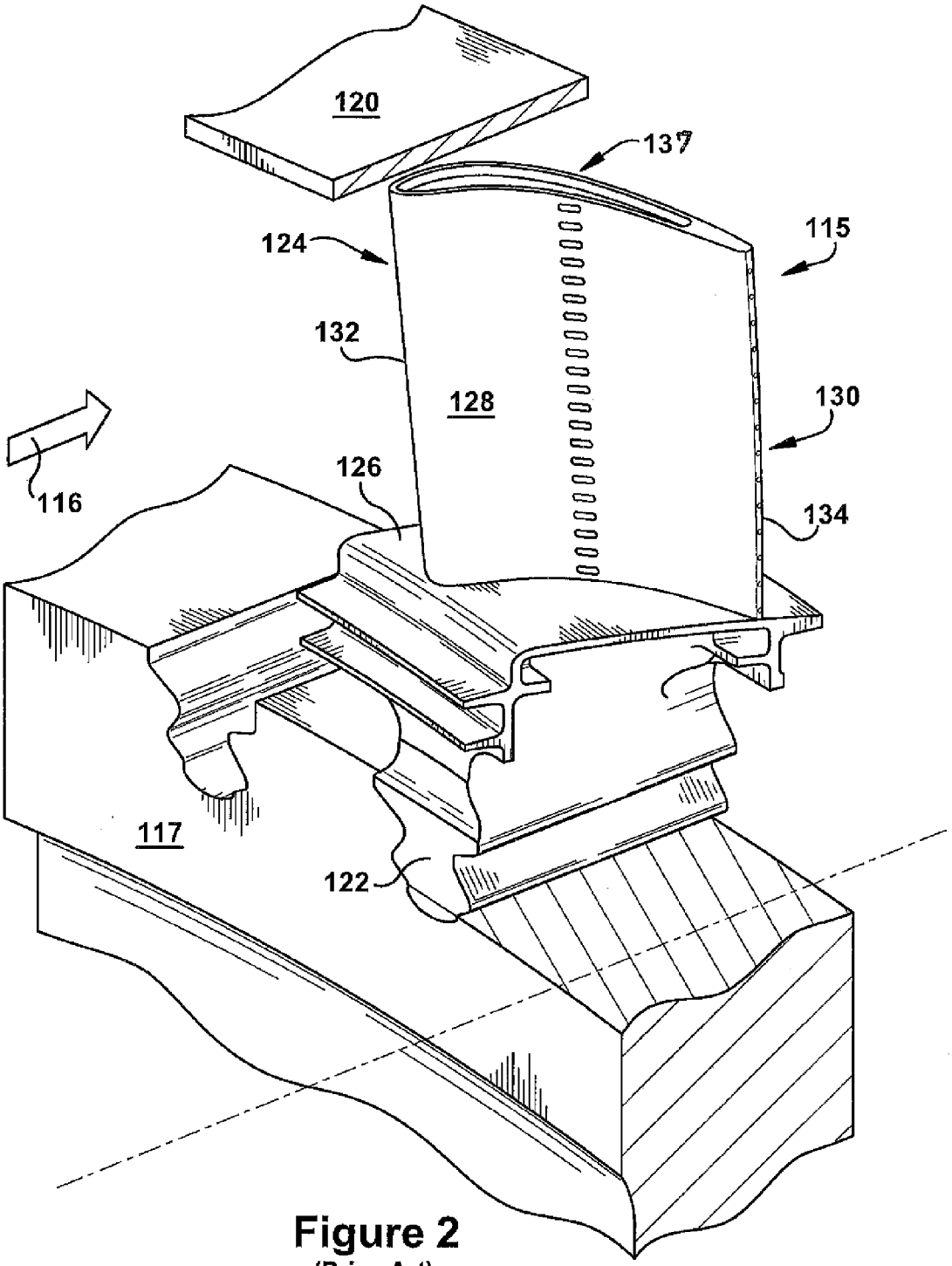
Figure 2 (Prior Art)
FIG. 2 is a perspective view of an exemplary rotor blade assembly including a rotor, a turbine blade, and a stationary shroud.

FIG. 2 is a perspective view of an exemplary hot gas path component, a turbine rotor blade 115 which is positioned in a turbine of a gas turbine or combustion engine. It will be appreciated that the turbine is mounted directly downstream from a combustor for receiving hot combustion gases 116 therefrom. The turbine, which is axisymmetrical about an axial centerline axis, includes a rotor disk 117 and a plurality of circumferentially spaced apart turbine rotor blades (only one of which is shown) extending radially outwardly from the rotor disk 117 along a radial axis. An annular turbine shroud 120 is suitably joined to a stationary stator casing (not shown) and surrounds the rotor blades 115 such that a relatively small clearance or gap remains therebetween that limits leakage of combustion gases during operation.

Each rotor blade 115 generally includes a root or dovetail 122 which may have any conventional form, such as an axial dovetail configured for being mounted in a corresponding dovetail slot in the perimeter of the rotor disk 117. A hollow airfoil 124 is integrally joined to dovetail 122 and extends radially or longitudinally outwardly therefrom. The rotor blade 115 also includes an integral platform 126 disposed at the junction of the airfoil 124 and the dovetail 122 for defining a portion of the radially inner flow path for combustion gases 116. It will be appreciated that the rotor blade 115 may be formed in any conventional manner, and is typically a one-piece casting. It will be seen that the airfoil 124 preferably includes a generally concave pressure sidewall 128 and a circumferentially or laterally opposite, generally convex suction sidewall 130 extending axially between opposite leading and trailing edges 132 and 134, respectively. The sidewalls 128 and 130 also extend in the radial direction from the platform 126 to a radially outer blade tip or tip 137.

Figure 3:
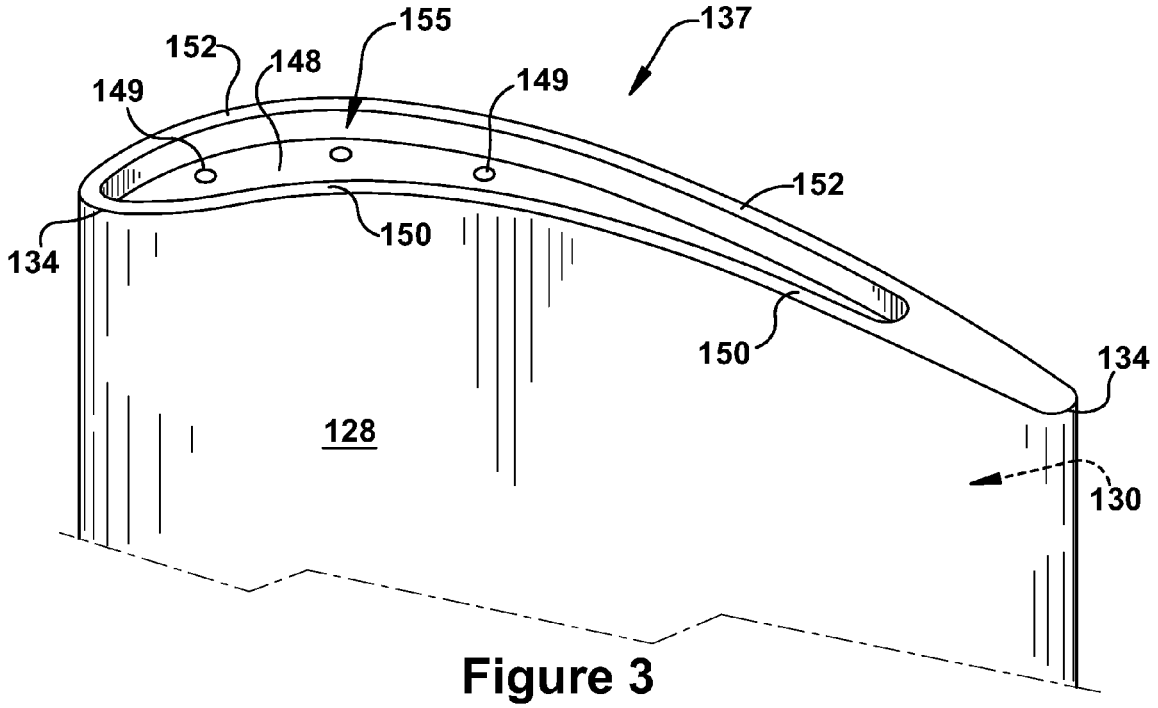
Figure 3 (Prior Art)
FIG. 3 is a perspective view of the tip of a rotor blade in which embodiments of the present application may be used.

FIG. 3 provides a close-up of an exemplary blade tip 137 on which embodiments of the present invention may be employed. In general, the blade tip 137 includes a tip plate 148 disposed atop the radially outer edges of the pressure 128 and suction sidewalls 130. The tip plate 148 typically bounds internal cooling passages (which will be simply referenced herein as an "airfoil chamber") that are defined between the pressure 128 and suction sidewalls 130 of the airfoil 124. Coolant, such as compressed air bled from the compressor, may be circulated through the airfoil chamber during operation. In some cases, the tip plate 148 may include film cooling outlets 149 that release cooling during operation and promote film cooling over the surface of the rotor blade 115. The tip plate 148 may be integral to the rotor blade 115 or, as shown, a portion (which is indicated by the shaded region) may be welded/brazed into place after the blade is cast.

Due to certain performance advantages, such as reduced leakage flow, blade tips 137 frequently include a tip rail or rail 150. Coinciding with the pressure sidewall 128 and suction sidewall 130, the rail 150 may be described as including a pressure side rail 152 and a suction side rail 153, respectively. Generally, the pressure side rail 152 extends radially outwardly from the tip plate 148 (i.e., forming an angle of approximately 90°, or close thereto, with the tip plate 148) and extends from the leading edge 132 to the trailing edge 134 of the airfoil 124. As illustrated, the path of pressure side rail 152 is adjacent to or near the outer radial edge of the pressure sidewall 128 (i.e., at or near the periphery of the tip plate 148 such that it aligns with the outer radial edge of the pressure sidewall 128). Similarly, as illustrated, the suction side rail 153 extends radially outwardly from the tip plate 148 (i.e., forming an angle of approximately 90° with the tip plate 148) and extends from the leading edge 132 to the trailing edge 134 of the airfoil. The path of suction side rail 153 is adjacent to or near the outer radial edge of the suction sidewall 130 (i.e., at or near the periphery of the tip plate 148 such that it aligns with the outer radial edge of the suction sidewall 130). Both the pressure side rail 152 and the suction side rail 153 may be described as having an inner surface 157 and an outer surface 159. It should be understood though that rail(s) may not necessarily follow the pressure or suction side rails. That is, in alternative types of tips in which the present invention may be used, the tip rails 150 may be moved away from the edges of the tip plate 148. Formed in this manner, it will be appreciated that the tip rail 150 defines a tip pocket or cavity 155 at the tip 137 of the rotor blade 115. As one of ordinary skill in the art will appreciate, a tip 137 configured in this manner, i.e., one having this type of cavity 155, is often referred to as a "squealer tip" or a tip having a "squealer pocket or cavity." The height and width of the pressure side rail 152 and/or the suction side rail 153 (and thus the depth of the cavity 155) may be varied depending on best performance and the size of the overall turbine assembly. It will be appreciated that the tip plate 148 forms the floor of the cavity 155 (i.e., the inner radial boundary of the cavity), the tip rail 150 forms the side walls of the cavity 155, and the cavity 155 remains open through an outer radial face, which, once installed within a turbine engine, is bordered closely by a stationary shroud 120 (see FIG. 2) that is slightly radially offset therefrom.

Figure 4:
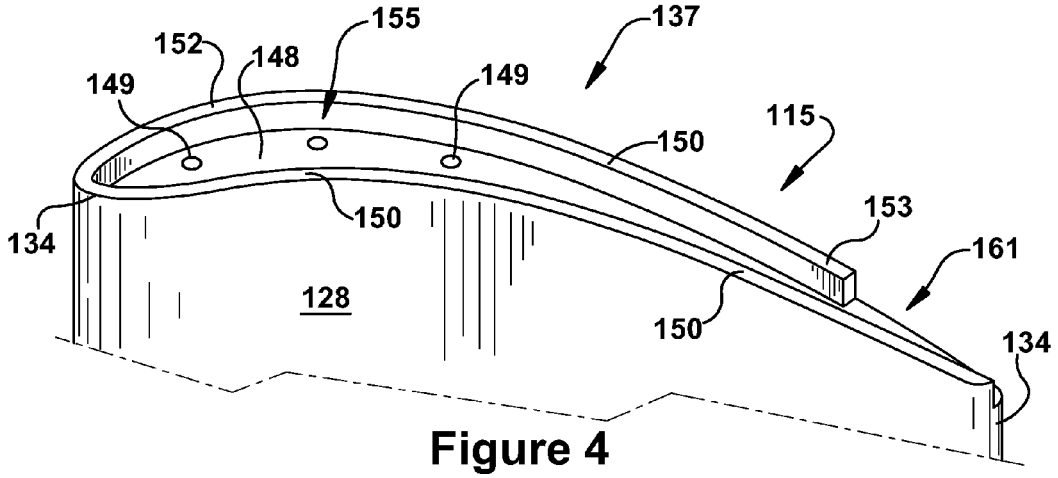
Figure 4 (Prior Art)
FIG. 4 is a perspective view of the trailing edge of an alternative rotor blade tip in which embodiments of the present application may be used.
Figure 5:
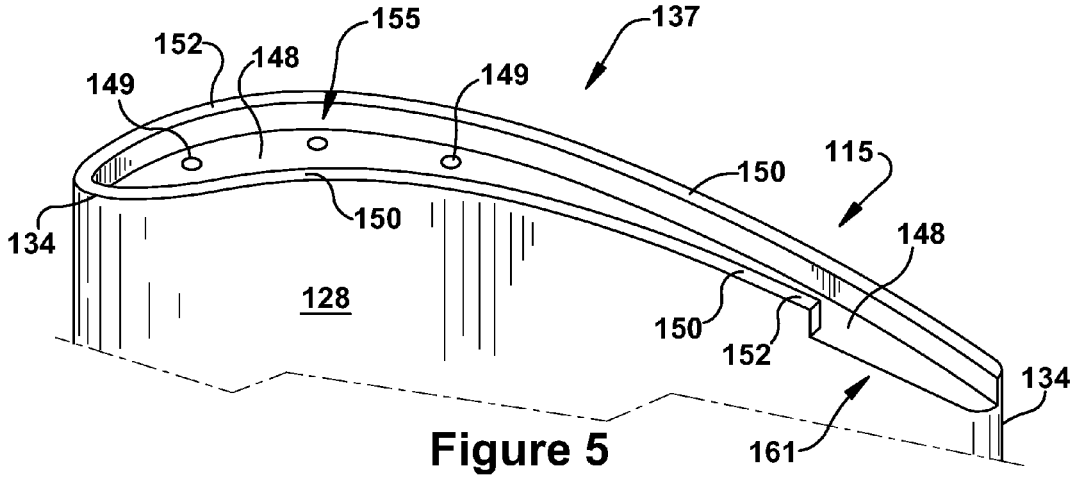
Figure 5 (Prior Art)
FIG. 5 is a perspective view of the trailing edge of another alternative rotor blade tip in which embodiments of the present application may be used.

FIGS. 4 and 5 illustrate known tip rail design alternatives for the trailing edges of rotor blade tips. While the several exemplary embodiments are primarily described in relation to certain tip rail design, it will be appreciated that the present invention may be adapted for use in differing types of tip rail design. In FIG. 4, for example, the tip rail 150 has a rail gap 161 along the suction side rail 153 near the trailing edge 134 of the airfoil 124. In FIG. 5, the tip rail 150 has a rail gap 161 along the pressure side rail 153 near the trailing edge 134 of the airfoil 124.

It will be appreciated that, within the airfoil 124, the pressure 128 and suction sidewalls 130 are spaced apart in the circumferential and axial direction over most or the entire radial span of airfoil 124 to define at least one internal airfoil chamber 156 through the airfoil 124. The airfoil chamber 156 generally channels coolant from a connection at the root of the rotor blade through the airfoil 124 so that the airfoil 124 does not overheat during operation via its exposure to the hot gas path. The coolant is typically compressed air bled from the compressor 102, which may be accomplished in a number of conventional ways. The airfoil chamber 156 may have any of a number of configurations, including, for example, serpentine flow channels with various turbulators therein for enhancing cooling air effectiveness, with cooling air being discharged through various holes positioned along the airfoil 124, such as the film cooling outlets 149 that are shown on the tip plate 148. As discussed in more detail below, it will be appreciated that such an airfoil chamber 156 may be configured or used in conjunction with surface cooling channels or microchannels of the present invention via machining or drilling a passage or connector that connects the airfoil chamber 156 to the formed surface cooling channel or microchannel. This may be done in any conventional manner. It will be appreciated that a connector of this type may be sized or configured such that a metered or desired amount of the coolant flows into the microchannel that it supplies. In addition, as discussed in more detail below, the microchannels described herein may be formed such that they intersect an existing coolant outlet (such as a film cooling outlet 149). In this manner, the microchannel may be supplied with a supply of coolant, i.e., the coolant that previously exited the rotor blade at that location is redirected such that it circulates through the microchannel and exits the rotor blade at another location.

As mentioned, one method used to cool certain areas of rotor blades and other hot gas path parts is through the usage of cooling passages formed very near and that run substantially parallel to the surface of the component. Positioned in this way, the coolant is more directly applied to the hottest portions of the component, which increases its cooling efficiency, while also preventing extreme temperatures from extending into the interior of the rotor blade. However, as one of ordinary skill in the art will recognize, these surface cooling passages—which, as stated, are referred to herein as "microchannels"—are difficult to manufacture because of their small cross-sectional flow area as well as how close they must be positioned near the surface. One method by which such microchannels may be fabricated is by casting them in the blade when the blade is formed. With this method, however, it is typically difficult to form the microchannels close enough to the surface of the component, unless very high-cost casting techniques are used. As such, formation of microchannels via casting typically limits the proximity of the microchannels to the surface of the component being cooled, which thereby limits their effectiveness. As such, other methods have been developed by which such microchannels may be formed. These other methods typically include enclosing grooves formed in the surface of the component after the casting of the component is completed, and then enclosing the grooves with some sort cover such that a hollow passageway is formed very near the surface.

One known method for doing this is to use a coating to enclose the grooves formed on the surface of the component. In this case, the formed groove is typically first filled with filler. Then, the coating is applied over the surface of the component, with the filler supporting the coating so that the grooves are enclosed by the coating, but not filled with it. Once the coating dries, the filler may be leached from the channel such that a hollow, enclosed cooling channel or microchannel is created having a desirably position very close to the component's surface. In a similar known method, the groove may be formed with a narrow neck at the surface level of the component. The neck may be narrow enough to prevent the coating from running into the groove at application without the need of first filling the groove with filler.

Another known method uses a metal plate to covers the surface of the component after the grooves have been formed. That is, a plate or foil is brazed onto the surface such that the grooves formed on the surface are covered. Another type of microchannel and method for manufacturing microchannels is described in copending patent application Ser. No. 13/479,710, which, as provided above, is incorporated herein. This application describes an improved microchannel configuration as well as an efficient and cost-effective method by which these surface cooling passages may be fabricated. In this case, a shallow channel or groove formed on surface of the component is enclosed with a cover wire/strip that is welded or brazed thereto. The cover wire/strip may be sized such that, when welded/brazed along its edges, the channel is tightly enclosed while remaining hollow through an inner region where coolant is routed.

The following US patent applications and patents describe with particularity ways in which such microchannels or surface cooling passages may be configured and manufactured, and are hereby incorporated in their entirety in the present application: U.S. Pat. No. 7,487,641; U.S. Pat. No. 6,528,118; U.S. Pat. No. 6,461,108; U.S. Pat. No. 7,900,458; and US Pat. App. No. 20020106457. It will be appreciated that, unless stated otherwise, the microchannels described in this application and, particularly, in the appended claims, may be formed via any of the above referenced methods or any other methods or processes known in the relevant arts.

Figure 6:
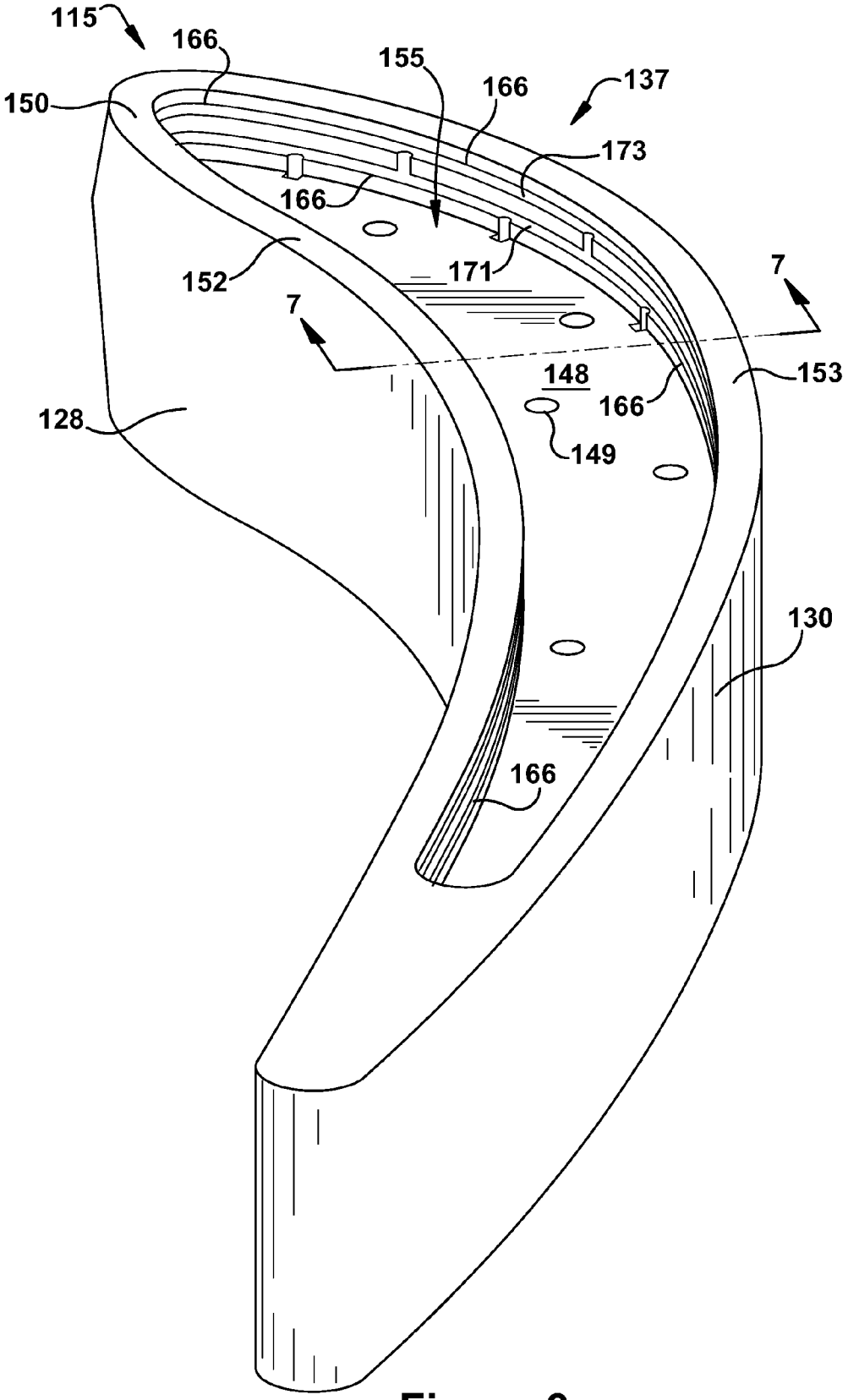
FIG. 6 is a perspective view of the tip of a rotor blade having an exemplary cooling channel according to one aspect of the present invention.

FIG. 6 is a perspective view of the inner surface 157 of a tip rail 150 having exemplary circumscribing cooling channels or microchannels (hereinafter "circumscribing rail microchannels 166") according to a preferred embodiment of the present invention. As used herein, a "circumscribing rail microchannel" refers to a microchannel positioned on the rail 150 that traverses a majority of the inner rail surface 157 and thereby surrounds at least a significant portion of the tip cavity 155. In certain preferred embodiments, the term "circumscribing rail microchannel" indicates a rail microchannel that circumscribes the entire inner rail surface 157, and, thus, surrounds the entire tip cavity 155. The circumscribing rail microchannel 166 may form a looped cooling circuit, with several inputs feeds and outlets spaced on the loop, as illustrated. It will be appreciated that FIG. 6 represents a view in which a channel cover 168 is not shown, and that, because of this, the circumscribing rail microchannels 166 are illustrated as unenclosed grooves or channels that are cut into the inner rail surface 157. The cover 168, which is shown in other figures and discussed below, is the structure that encloses the grooves of the circumscribing rail microchannels 166.

In one preferred embodiment, the circumscribing rail microchannels 166 include two parallel channels that circumscribe or ring the inner rail surface 157 of the rail 150. As stated, being uncovered, the circumscribing rail microchannels 166 of FIG. 6 resemble narrow and shallow grooves that may be machined into the surface of the rotor blade 115. The cross-sectional profile of the groove may be rectangular or semi-circular, though other shapes are also possible. In a preferred embodiment, the circumscribing rail microchannels 166 extend around the tip cavity 155 in parallel, and are evenly spaced between the base of the rail 150 and the outboard edge or surface of the rail 150 such that the cooling effect during operation is spread more evenly through the rail 150. The circumscribing rail microchannels 166 may be described as including an inboard microchannel 171, which is positioned near the base of the rail 150, and an outboard microchannel 173, which is positioned near the outer edge of the rail 150.

As discussed in more detail below, in a preferred embodiment, a source connector 167 connects the circumscribing rail microchannels 166 to a coolant source within the airfoil chamber 156. The source connector 167 may be an internal passageway that extends between the inboard microchannel 171 and the airfoil chamber 156. The source connector 167 may be machined after casting of the blade is complete. Other coolant supply alternatives are also possible, as discussed below.

In alternative embodiments, a single circumscribing rail microchannel 166 may be formed that rings the inner rail surface 157. Additionally, more than two circumscribing rail microchannels 166 may be provided, each of which circumscribes the inner rail surface 157. The circumscribing rail microchannels 166 may be linear or may include curved portions (not shown) if particularly hotspots need addressing and a curved path along the inner rail surface 157 is necessary to reach them. The one or more circumscribing rail microchannels 166 may be formed such that each is approximately parallel to the tip plate 148.

Figure 7:
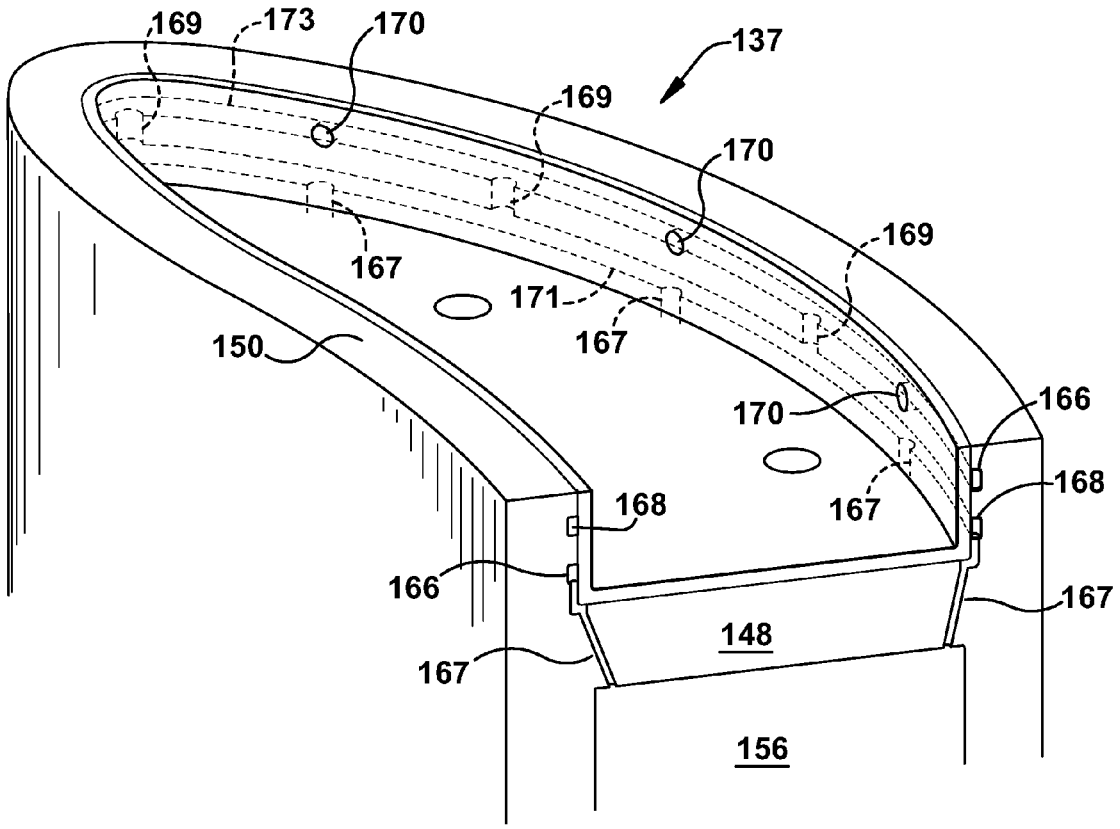
FIG. 7 is a perspective view with section taken along 5-5 of the exemplary embodiment of FIG. 4.
Figure 8:
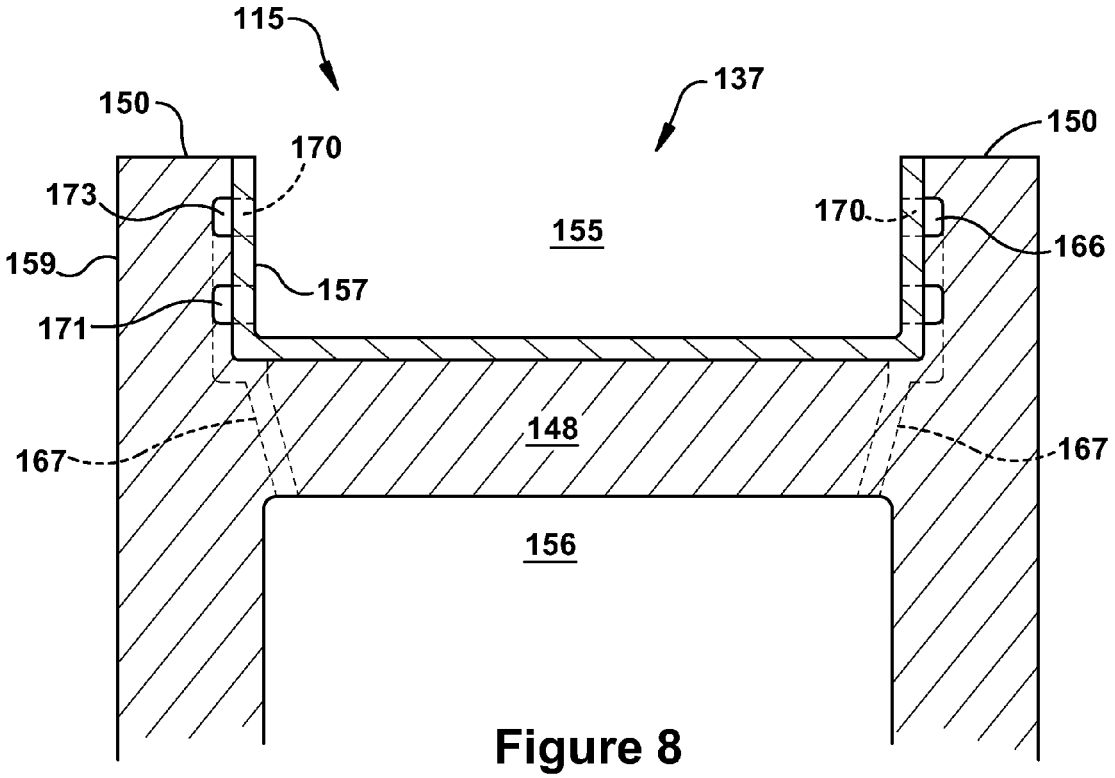
FIG. 8 is a side view with a section taken along 5-5 of the exemplary embodiment of FIG. 4.

FIGS. 7 and 8 provide section views along the noted cut line 7-7 of FIG. 6. It will be appreciated that in FIG. 6, the channel cover or cover 168 is omitted, which is done so that the circumscribing rail microchannels 166 are shown more clearly. In FIGS. 7 and 8, the channel covers 168 are provided. It will be appreciated that the channel cover 168 is the structure that encloses the channel 168, or, more precisely, the structure that resides between the microchannel 166 and the tip cavity 155. In FIGS. 7 and 8, for example, a coating may be used to enclose grooves that had been machined into the inner rail surface 157. The coating encloses the grooves such that the circumscribing rail microchannels 166 are formed. The coating may be any suitable coating for this purpose, including an environmental barrier coating. In other embodiments, the cover 168 may be an integral component to the blade 115. In this case, the microchannels 168 would have been cast into the blade 115 during its formation. As stated, though, the precision necessary for this type of casting increases cost dramatically. In another example, the cover 168 of FIGS. 7 and 8 may be a thin plate or foil that is welded or brazed onto the rail 150. In another example, the cover 168 may be a wire/strip that is welded/brazed into place (as the process described in the above referenced, co-pending application Ser. No. 13/479,710.

It will be appreciated that FIGS. 6 through 8 illustrate a microchannel configuration that may be efficiently added to existing rotor blades after casting or after usage. That is, existing rotor blades may be conveniently retrofitted with circumscribing rail microchannels 166 to address cooling deficiency in the blade tip 137 that may be caused by changing firing temperatures or conditions. To achieve this, a groove may be machined in the inner surface 157 of the rail 150. The machining may be completed by any known machining process. The groove may be connected to a coolant source via a machined or drilled passageway through the tip plate 148, which is referred to herein as source connector 167. Then a cover 168 may be used to enclose the groove such that a circumscribing rail microchannel 166 is created.

Microchannel outlets 170 may be formed at intervals along the circumscribing rail microchannels 166. As shown, a rail connector 169 may connect the inboard microchannel 171 to the outboard microchannel 173. As illustrated, this preferred configuration may allow coolant to flow from a source within the airfoil chamber 156 into the inboard microchannel 171. The coolant then may flow through the inboard microchannel 171 to a rail connector 169, which, as illustrated, may be staggered from source connectors 167 to promote a winding path that benefits heat removal. The coolant then may flow from the inboard microchannel 171 to the outboard microchannel 173 via the rail connectors 169. Once in the outboard microchannel 173, the coolant may flow to one of the outlets 170, which may be staggered from the rail connectors 169.

In certain preferred embodiments, a circumscribing rail microchannel 166 is defined herein to be an enclosed restricted internal passageway that extends very near and approximately parallel to an exposed outer surface of the rotor blade. In certain preferred embodiments, and as used herein where indicated, a circumscribing rail microchannel 166 is a coolant channel that is positioned less than about 0.050 inches from the outer surface of the rotor blade, which, depending on how the circumscribing rail microchannel 166 is formed, may correspond to the thickness of the channel cover 168 and any coating that encloses the circumscribing rail microchannel 166. More preferably, such a microchannel resides between 0.040 and 0.020 inches from the outer surface of the rotor blade.

In addition, the cross-sectional flow area is typically restricted in such microchannels, which allows for the formation of numerous microchannels over the surface of a component, and the more efficient usage of coolant. In certain preferred embodiments, and as used herein where indicated, a circumscribing rail microchannel 166 is defined as having a cross-sectional flow area of less than about 0.0036 inches$^2$. More preferably, such microchannels have a cross-sectional flow area between about 0.0025 and 0.009 inches$^2$. In certain preferred embodiments, the average height of a circumscribing rail microchannel 166 is between about 0.020 and 0.060 inches, and the average width of a circumscribing rail microchannel 166 is between about 0.020 and 0.060 inches.

Figure 9:
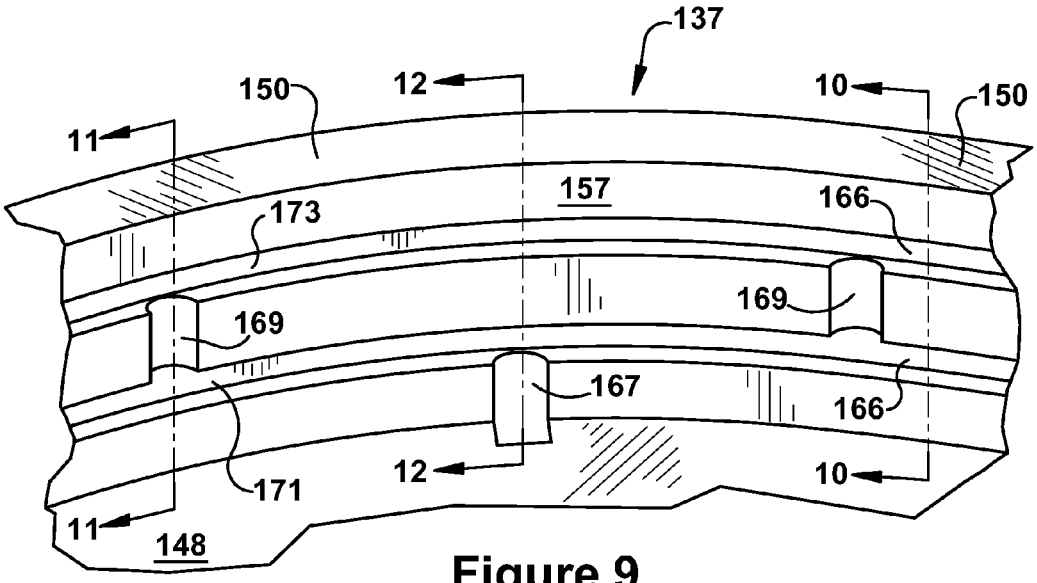
FIG. 9 is a side view from within the tip cavity of an exemplary cooling channel configuration according to an aspect of present invention.
Figure 12:
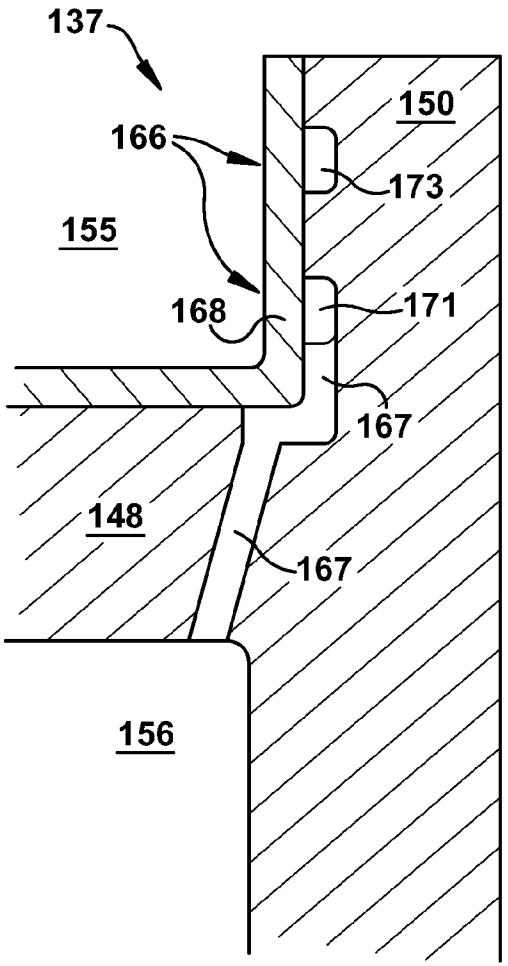
FIG. 12 is a section view of along 12-12 of the exemplary embodiment of the FIG. 9.
Figure 11:
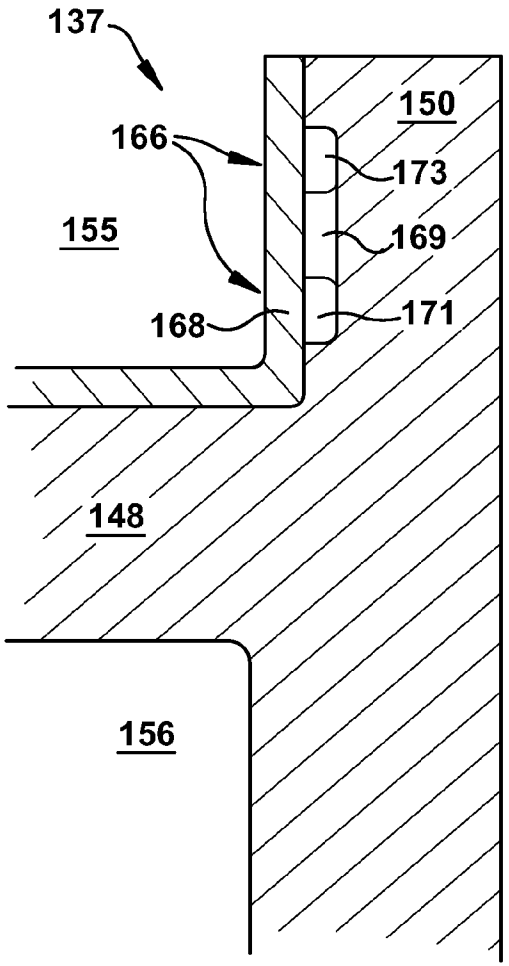
FIG. 11 is a section view of along 11-11 of the exemplary embodiment of the FIG. 9.
Figure 10:
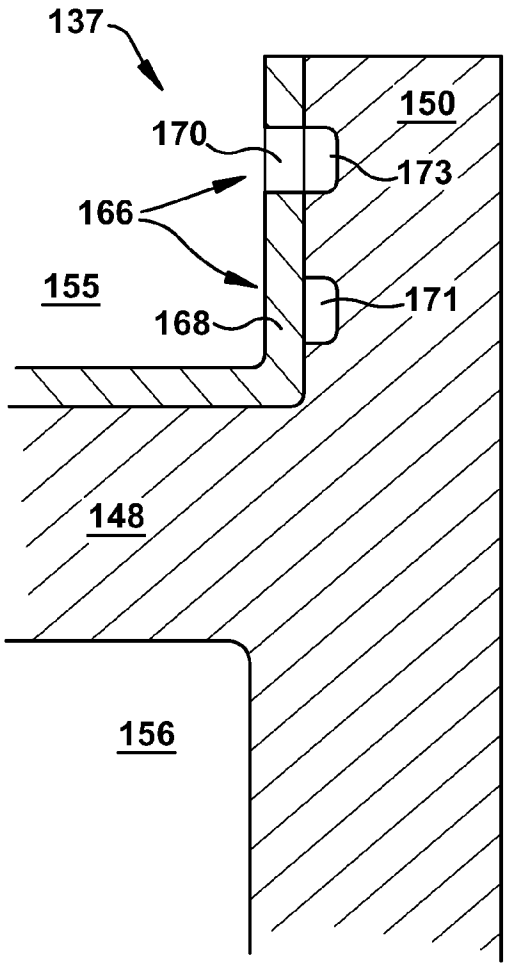
FIG. 10 is a section view of along 10-10 of the exemplary embodiment of the FIG. 9.

FIG. 9 provides a side view from within the tip cavity 155 of an exemplary configuration of circumscribing rail microchannels 166 according to another aspect of present invention. FIG. 10 is a section view of along 10-10 of the exemplary embodiment of the FIG. 9. FIG. 11 is a section view of along 11-11 of the exemplary embodiment of the FIG. 9. And, FIG. 12 is a section view of along 12-12 of the exemplary embodiment of the FIG. 9. In FIG. 9, the channel cover 168 is again stripped away so that the grooves that form the circumscribing rail microchannels 166 are shown more clearly. As described above, a pair of circumscribing rail microchannels 166 may extend in spaced relation around the inner rail surface 157. A source connector 167 may connect the inboard circumscribing rail microchannel 166 to a coolant source in the airfoil chamber 156. A rail connector 169 may connect the inboard circumscribing rail microchannel 171 to the outboard circumscribing rail microchannel 172. An outlet 170 may be formed in the outboard circumscribing rail microchannel 172. It will be appreciated that other configurations are also possible, and that the above described example is not intended to be limiting except as specifically provided in the claims below where certain preferred embodiments are claimed.

Figure 13:
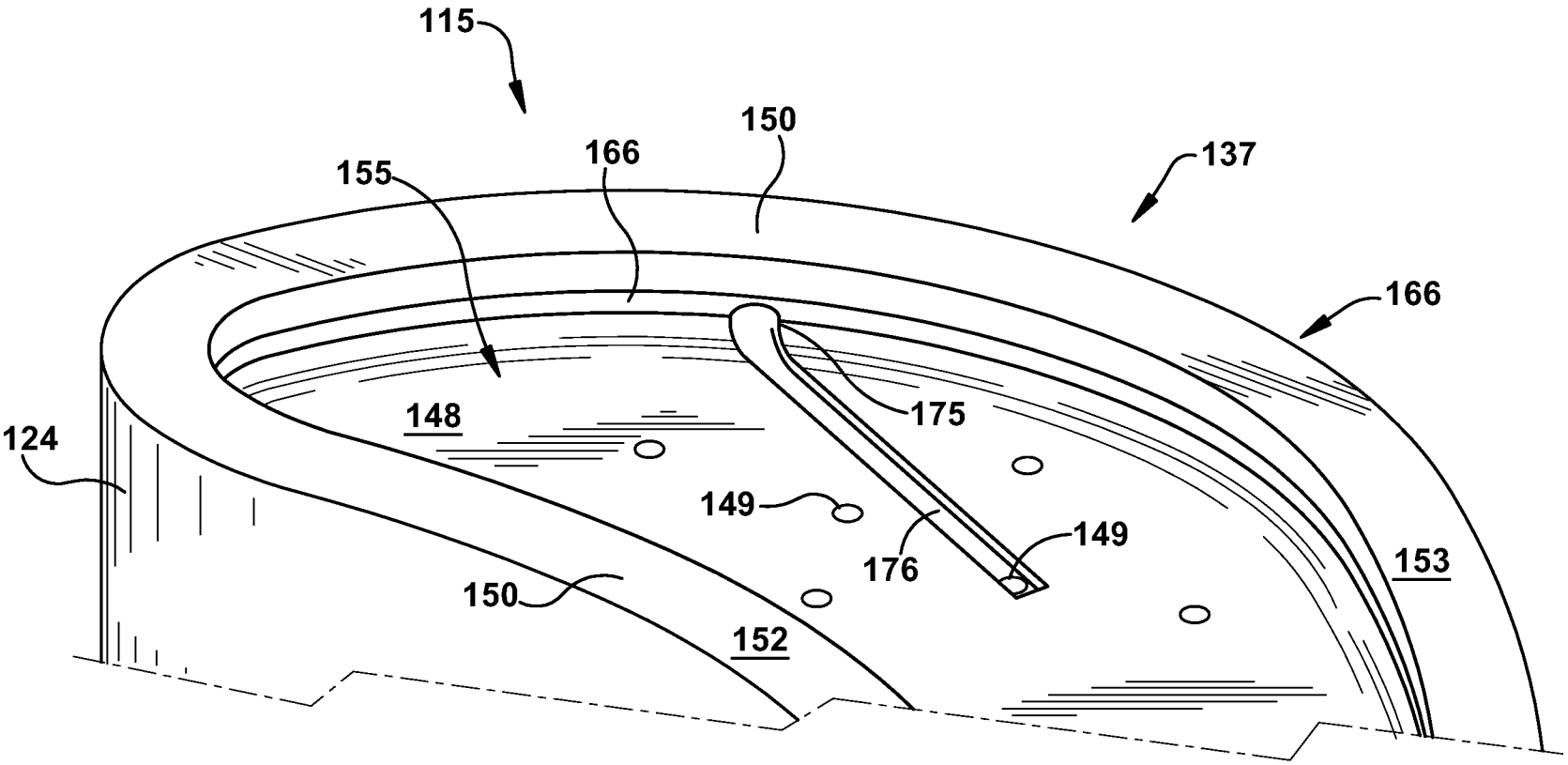
FIG. 13 is a perspective view of a rotor blade tip having an exemplary circumscribing rail microchannel having a tip plate feed channel.

FIG. 13 is a perspective view of a rotor blade tip 137 having an exemplary circumscribing rail microchannel 166 according to another aspect of the present invention. In this case, the circumscribing rail microchannels 166 are supplied via an existing film coolant outlet 149 instead of a source connector 167. As before, it will be appreciated that in FIG. 13, the cover 168 is not shown for illustrating purposes. FIG. 13 instead shows connecting grooves: a first groove 175 formed in the rail 150; and a second groove 176 formed in the tip plate 148 that connects to the first groove 175. It will be appreciated that the combination of the first groove 175 and the second groove 176 and a suitable enclosing cover 168 may supply the circumscribing rail microchannels 166 with the coolant that previously exited the turbine blade 115 through the film coolant outlet 149. Specifically, at an upstream side, the second groove 176 may intersect the existing film cooling outlet 149. The second groove 176 then may extend toward an upstream end of the first groove 175 and make a connection therewith, as illustrated. The first groove 175 then may extend toward the circumscribing rail microchannel 166 and make a connection therewith. As stated, in certain exemplary embodiments, only one circumscribing rail microchannels 166 is formed within the rail 150. Additionally, multiple second grooves 176 can be formed to supply rail microchannel(s) 166 at different locations along the rail microchannel(s) length.

In preferred embodiments, multiple coolant feeds may be provided to each of the circumscribing rail microchannels 166. Where applicable, multiple rail connectors 169 may provide several paths by which several circumscribing rail microchannels 166 fluidly communicate with each other. Also, multiple outlets 170 may be included on each of the circumscribing rail microchannels 166 so that each expels circulating coolant. It will be appreciated that these multiple pathways provide redundancy so that cooling the tip plate 137 continues even if manufacturing defects or blockage prevents one of the interior connecting channels from functioning as intended.

Figure 14:
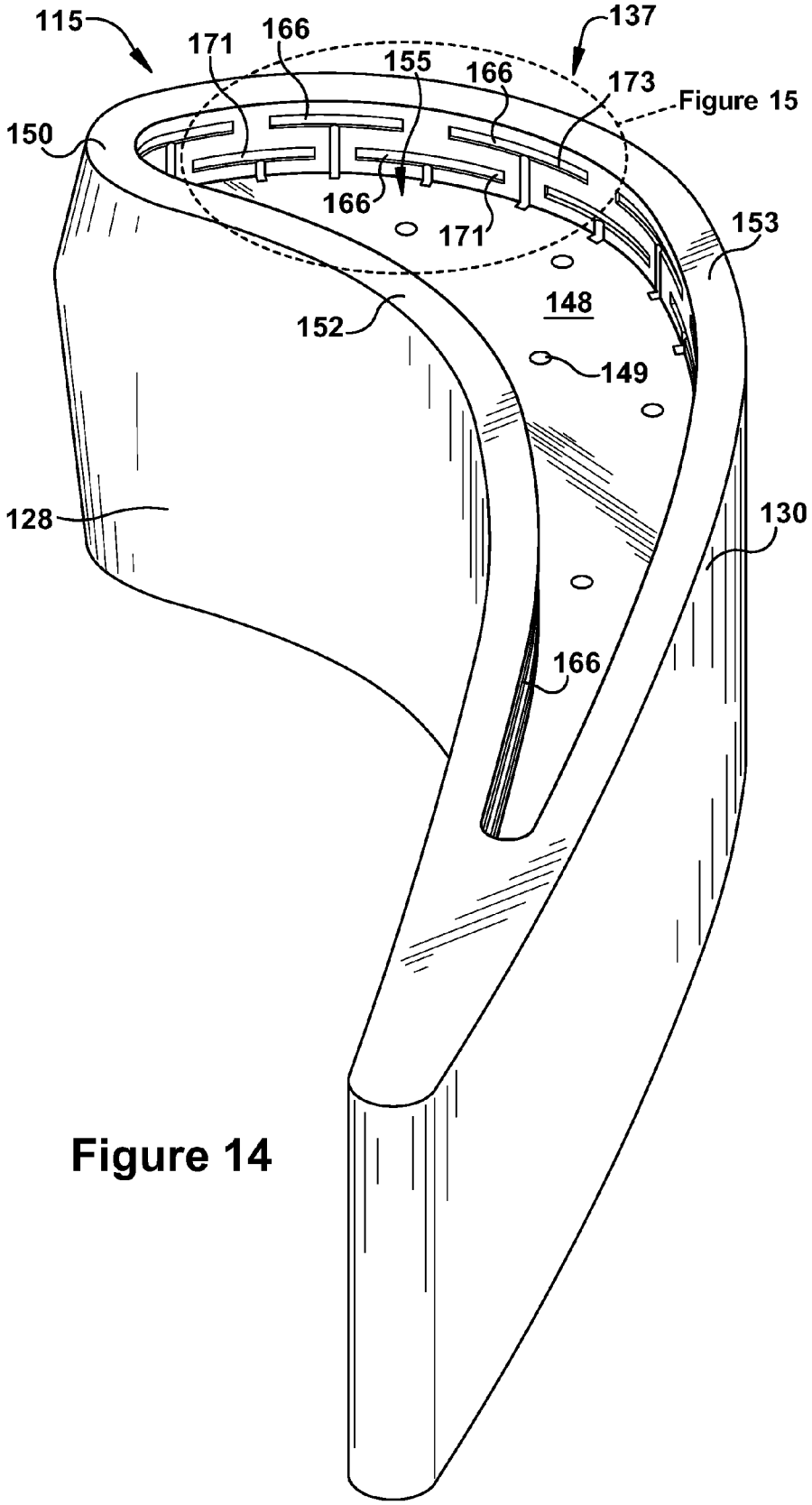
FIG. 14 is a perspective view of a tip of a rotor blade having exemplary cooling channels according to another aspect of the present invention.
Figure 15:
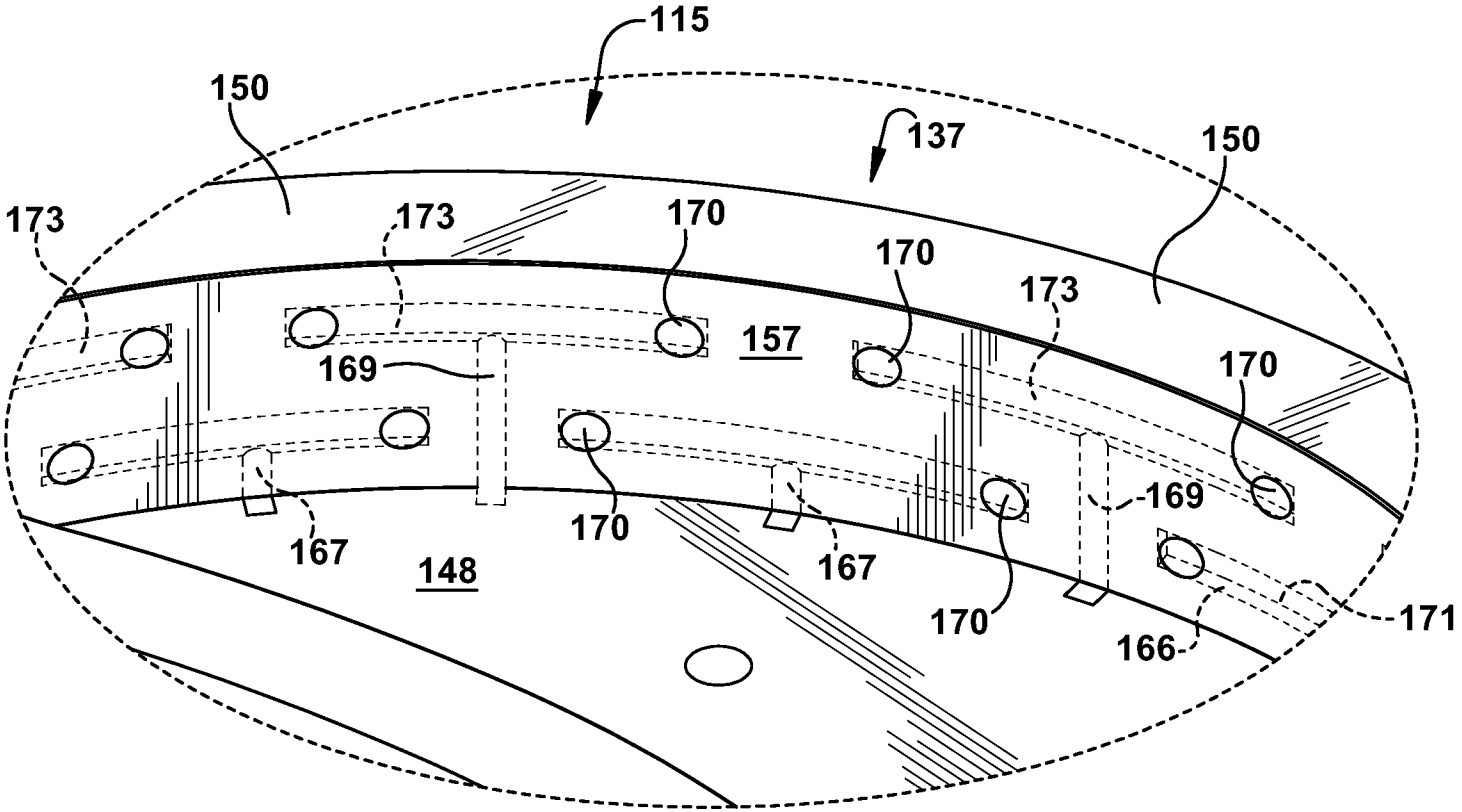
FIG. 15 is a close-up in perspective of the rotor blade tip of FIG. 13.

FIGS. 14 and 15 illustrate an alternative embodiment of the present invention. FIG. 14 provides a perspective view of the tip 137 of a rotor blade 115 having exemplary circumscribing rail microchannels 166 according to another aspect of the present invention, and FIG. 15 is a close-up perspective view of the rotor blade tip 137 of FIG. 14. It will be appreciated that the circumscribing rail microchannels 166 of FIG. 14 are shown with the channel cover 168 stripped away, while, in FIG. 15, the circumscribing rail microchannels 166 are illustrated with the channel cover 168 in place. As shown, in this embodiment, the circumscribing rail microchannels 166 are intermittently formed around the inner surface 157 of the rail 150. That is, the circumscribing rail microchannels 166 extend along a circumscribing path on the inner surface 157 of the tip rail 150, and include regular gaps on the circumscribing path where the microchannels 166 are interrupted. This configuration may be described as forming a number of "discrete microchannel spans" that extend around the rail 150 with gaps formed therebetween. As illustrated, because each discrete microchannel span is not connected to the neighboring discrete microchannel spans, each has a dedicated coolant supply. As described in more detail above, the supply may be a source connector 167 (as shown in FIGS. 14 and 15), a microchannel supply from a preexisting film cooling outlet 149, a combination thereof, or other type of supply. As shown in FIG. 15, each discrete microchannel span of the circumscribing rail microchannel 166 may have one or more outlets 170. In a preferred embodiment, each discrete microchannel span may have outlets 170 disposed at or near each end, as illustrated.

In a preferred embodiment, the intermittent circumscribing microchannels 166 include an inboard circumscribing rail microchannel 171 and an outboard circumscribing rail microchannel 173. The discrete spans of each of these may be staggered such that the discrete spans of the inboard circumscribing rail microchannel 171 and those of the outboard circumscribing rail microchannel 173 overlap, as illustrated in FIGS. 14 and 15. In this manner, it will be appreciated that effective cooling coverage may be provided to the region, while also allowing for a desired level of redundant or duplicative cooling coverage in case any of the discrete spans become non-functioning due to manufacturing defects or operational anomalies.

Given the effectiveness of the microchannel cooling, what was a difficult to cool region—i.e., the squealer tip of a rotor blade—may be addressed with a reduced amount of coolant usage, which would improve overall turbine efficiency. The configuration of such microchannel cooling allows for efficient construction of such systems in new and existing rotor blades.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

We claim:

1. A turbine rotor blade for a gas turbine engine, the turbine rotor blade comprising an airfoil that includes a tip at an outer radial end;

wherein the tip includes a rail that defines a tip cavity;

wherein the rail includes a circumscribing rail microchannel; and wherein:

the airfoil includes a pressure sidewall and a suction sidewall that join together at a leading edge and a trailing edge of the airfoil, the pressure sidewall and the suction sidewall extending from a root to the tip and defining an airfoil chamber therein;

the tip includes a tip plate, the rail being disposed near or at a periphery of the tip plate;

the rail includes an inner rail surface, which faces inwardly toward the tip cavity, and an outer rail surface; and the circumscribing rail microchannel comprises a microchannel that extends around at least a majority of the length of the inner rail surface;

further comprising a feed microchannel that extends across the tip plate and a portion of the rail, the feed microchannel comprising an upstream end, which is positioned on the tip plate, and a downstream end, which is positioned on the rail;

wherein the upstream end of the feed microchannel connects to a coolant passageway that passes through the tip plate to an airfoil chamber; and wherein the downstream end fluidly connects to the circumscribing rail microchannel.

2. The turbine rotor blade according to claim 1, wherein the circumscribing rail microchannel comprises a microchannel that extends around the inner rail surface to surround the tip cavity; and wherein the circumscribing rail microchannel comprises a looped coolant path.

3. The turbine rotor blade according to claim 1, wherein the pressure sidewall comprises an outer radial edge and the suction sidewall comprises an outer radial edge, the airfoil being configured such that the tip plate extends axially and circumferentially to connect the outer radial edge of the suction sidewall to the outer radial edge of the pressure sidewall;

wherein the rail includes a pressure side rail and a suction side rail, the pressure side rail connecting to the suction side rail at the leading edge and the trailing edge of the airfoil;

wherein the pressure side rail extends radially outward from the tip plate, traversing from the leading edge to the trailing edge such that the pressure side rail approximately aligns with the outer radial edge of the pressure sidewall; and wherein the suction side rail extends radially outward from the tip plate, traversing from the leading edge to the trailing edge such that the suction side rail approximately aligns with the outer radial edge of the suction sidewall.

4. The turbine rotor blade according to claim 3, wherein the pressure side rail and the suction side rail are substantially continuous between the leading edge to the trailing edge of the airfoil, and define the tip cavity therebetween; and wherein the airfoil chamber comprises an internal chamber configured to circulate a coolant during operation.

5. The turbine rotor blade according to claim 4, further comprising:

a source connector, wherein the source connector comprises a hollow passageway fluidly connecting the circumscribing rail microchannel to the airfoil chamber; and an outlet, wherein the outlet comprises a hollow passageway fluidly connecting the circumscribing rail microchannel to a port formed on the inner rail surface.

6. The turbine rotor blade according to claim 1, wherein the circumscribing rail microchannel comprises a non-integral cover which encloses a machined groove; and wherein the non-integral cover comprises one of a coating, a sheet, foil, and a wire.

7. The turbine rotor blade according to claim 1, wherein the circumscribing rail microchannel is disposed to traverse through an area on the rail that is a known hotspot.

8. The turbine rotor blade according to claim 1, wherein the circumscribing rail microchannel comprises an enclosed hollow passageway that extends near and approximately parallel to the inner rail surface of the rail; and wherein the circumscribing rail microchannel extends around the inner rail surface in spaced relation to the tip plate.

9. The turbine rotor blade according to claim 8, wherein the circumscribing rail microchannel resides less than about 0.05 inches from the inner rail surface;

wherein the circumscribing rail microchannel comprises a cross-sectional flow area of less than about 0.0036 $inches^2$; and wherein the circumscribing rail microchannel comprises an average height of between 0.02 and 0.06 inches and an average width of between 0.02 and 0.06 inches.

10. The turbine rotor blade according to claim 8, wherein the circumscribing rail microchannel resides between about 0.04 and 0.02 inches from the inner rail surface;

wherein the circumscribing rail microchannel comprises a cross-sectional flow area of between about 0.0025 and 0.0009 $inches^2$; and wherein the circumscribing rail microchannel comprises an average height of between 0.02 and 0.06 inches and an average width of between 0.02 and 0.06 inches.

11. The turbine rotor blade according to claim 1, wherein the coolant passageway through the tip plate comprises an outlet that is configured to function as a film coolant outlet; and wherein the feed microchannel is configured to direct the coolant that would have exited the turbine blade from the film coolant outlet to the circumscribing rail microchannel.

12. A turbine rotor blade for a gas turbine engine, the turbine rotor blade comprising an airfoil that includes a tip at an outer radial end; wherein the tip includes a rail that defines a tip cavity; wherein the rail includes a circumscribing rail microchannel; and wherein the airfoil includes a pressure sidewall and a suction sidewall that join together at a leading edge and a trailing edge of the airfoil, the pressure sidewall and the suction sidewall extending from a root to the tip and defining an airfoil chamber therein; the tip includes a tip plate, the rail being disposed near or at a periphery of the tip plate; the rail includes an inner rail surface, which faces inwardly toward the tip cavity, and an outer rail surface; the circumscribing rail microchannel comprises a microchannel that extends around at least a majority of the length of the inner rail surface; wherein the circumscribing rail microchannel are formed intermittently along the at least majority of the length of the inner rail surface; wherein the intermittent formation comprises at least a plurality of discrete microchannel spans; wherein the intermittently formed circumscribing rail microchannel includes an outboard intermittently formed circumscribing rail microchannel and an inboard intermittently formed circumscribing rail microchannel, the outboard and inboard intermittently formed circumscribing rail microchannels being staggered such that the gaps of each do not coincide and the microchannels of each overlap.

13. The turbine rotor blade according to claim 12, wherein the intermittently formed circumscribing rail microchannels comprise gaps formed between each of the plurality of discrete microchannel spans; and wherein each of the plurality of discrete microchannel spans include a dedicated coolant supply.

14. The turbine rotor blade according to claim 13, wherein each of the discrete microchannel spans comprises one or more outlets, each of the outlets comprising a port disposed on the inner rail surface.

15. The turbine rotor blade according to claim 14, wherein each of the discrete microchannel spans comprises at least two outlets;

wherein one of the two outlets is positioned near one end of the discrete microchannel span and the other of the two outlets is positioned the other end of the discrete microchannel span.

16. A turbine rotor blade for a gas turbine engine, the turbine rotor blade comprising an airfoil that includes a tip at an outer radial end;

wherein the tip includes a rail that defines a tip cavity;

wherein the rail includes a circumscribing rail microchannel; and wherein:

the airfoil includes a pressure sidewall and a suction sidewall that join together at a leading edge and a trailing edge of the airfoil, the pressure sidewall and the suction sidewall extending from a root to the tip and defining an airfoil chamber therein;

the tip includes a tip plate, the rail being disposed near or at a periphery of the tip plate;

the rail includes an inner rail surface, which faces inwardly toward the tip cavity, and an outer rail surface; and the circumscribing rail microchannel comprises a microchannel that extends around at least a majority of the length of the inner rail surface;

further comprising a second circumscribing rail microchannel such that inner rail surface of the rail includes an inboard circumscribing rail microchannel disposed nearer to a base of the rail and an outboard circumscribing rail microchannel disposed nearer an outer edge of the rail.

17. The turbine rotor blade according to claim 16, wherein the inboard circumscribing rail microchannel and the outboard circumscribing rail microchannel are parallel and regularly spaced between the base and the outer edge of the rail.

18. The turbine rotor blade according to claim 16, further comprising a plurality of source connectors that are configured to fluidly connect the inboard circumscribing rail microchannel to the airfoil chamber, each of the source connectors comprising an internal passageway extending between the inboard circumscribing rail microchannel and the airfoil chamber.

19. The turbine rotor blade according to claim 18, further comprising a plurality of rail connectors, wherein each of the rail connectors comprises an internal passageway that fluidly connects the inboard circumscribing rail microchannel to the outboard circumscribing rail microchannel;

wherein the outboard circumscribing rail microchannel comprises a plurality of outlets formed at intervals along the outboard circumscribing rail microchannel, each of the outlets comprising a hollow passageway fluidly connecting the outboard circumscribing rail microchannel to a port formed on the inner rail surface.

* * * * *